United States Patent [19]

Dumser

[11] Patent Number: 4,890,646

[45] Date of Patent: Jan. 2, 1990

[54] FLEXIBLE SIPHON PIPE FOR TANK CAR

[75] Inventor: Paul J. Dumser, St. Charles County

[73] Assignee: ACF Industries, Incorporated, Earth City, Mo.

[21] Appl. No.: 338,862

[22] Filed: Apr. 17, 1989

[51] Int. Cl.[4] ..... B61D 5/00

[52] U.S. Cl. ..... 137/590; 137/152; 137/350; 105/358; 105/360

[58] Field of Search ..... 137/590, 152, 350; 105/358, 360

[56] References Cited

U.S. PATENT DOCUMENTS

| | | | |
|---|---|---|---|
| 1,683,021 | 9/1928 | Brown | 137/590 X |
| 1,894,655 | 1/1933 | Auchincloss | 137/590 X |
| 2,174,354 | 9/1939 | Shields | 137/590 X |
| 4,008,739 | 2/1977 | Hurst et al. | 141/35 |
| 4,114,783 | 9/1978 | Wempe et al. | 222/398 |
| 4,184,511 | 1/1980 | Wilson | 137/590 |
| 4,219,047 | 8/1980 | Polley | 137/590 |
| 4,220,097 | 9/1980 | Wempe et al. | 105/360 |
| 4,237,928 | 12/1980 | Messersmith | 137/590 |
| 4,248,261 | 2/1981 | Carlson | 137/590 |
| 4,315,531 | 2/1982 | Gerhard | 137/590 X |
| 4,445,630 | 5/1984 | Gartman et al. | 137/590 X |
| 4,513,795 | 4/1985 | Davis et al. | 141/35 |

OTHER PUBLICATIONS

ACF catalog sheet–26,800 Gallon Capacity Slope Bottom Tank Cars–Jan. 1983.

*Primary Examiner*—John Rivell

*Attorney, Agent, or Firm*—Polster, Polster and Lucchesi

[57] ABSTRACT

An eduction or siphon pipe in a railway tank car extends from adjacent a bottom sump area to a fitting in a top area of the car. The railway tank car has a generally curvilinear inner wall, and the eduction pipe is provided with a shape corresponding to the generally curvilinear inner wall and is supported in proximity thereto. This enables the eduction pipe to readily accommodate radial distortions of the railway tank car during transport. In addition, all (or substantially all) of the fluid commodity in the railway tank car can be withdrawn through the eduction pipe since the lower end thereof may be positioned in close proximity to the bottom sump without concern for radial distortion or deflection of the tank car.

14 Claims, 2 Drawing Sheets

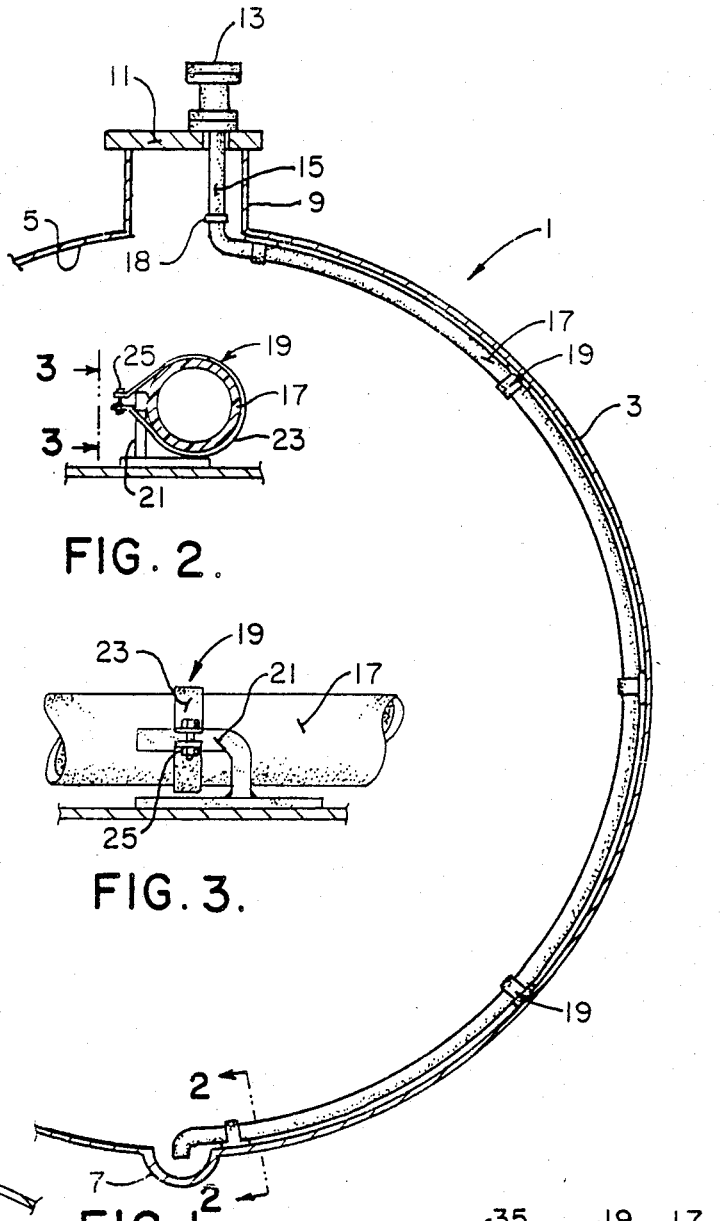
FIG. 1.
FIG. 2.
FIG. 3.
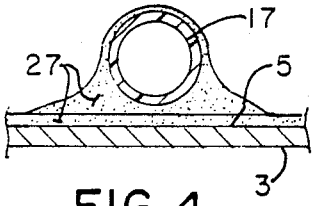
FIG. 4.
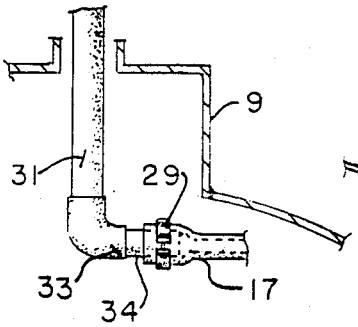
FIG. 5.
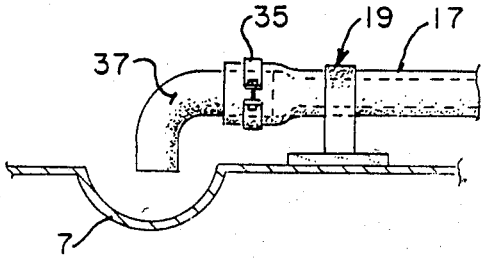
FIG. 6.

FLEXIBLE SIPHON PIPE FOR TANK CAR

BACKGROUND OF THE INVENTION

The present invention relates to an eduction or siphon pipe for a railway tank car, and more particularly, to such an eduction pipe which has a shape corresponding to the generally curvilinear inner wall of the railway tank car, in order that the eduction pipe can readily accommodate radial distortions of the railway tank car when in service.

Eduction or siphon pipes are used in railway tank cars for loading and unloading liquid ladings through a valve on the top of the car. Eduction pipes are typically constructed to extend downwardly from the valve at the top of the car and terminate adjacent the bottom of the car, sometimes in the vicinity of a bottom sump area.

In order to remove all or substantially all of a liquid commodity within the tank car, prior art constructions have found it desirable to locate the lower end of eduction pipe as close as possible to the bottom of the tank car, such as within a bottom sump area. If the eduction pipe terminates a given distance above the tank bottom, some of the fluid commodity will be left in the bottom of the tank car after it is unloaded. Yet, it has not been possible to locate the lower end of the eduction pipe with little or no clearance relative to the bottom of the tank car or bottom sump area, since the railway tank car, is subjected to radial distortions or deflections. Such residual lading is undesirable because not all of the lading can be offloaded and because even relatively small quantities of certain environmentally hazardous materials are difficult and expensive to dispose of in a safe manner. Forces resulting from loading and unloading the fluid commodity, the movement of the train, and coupler impacts have caused the tank shell to flex in service resulting in the above-noted radial deflection of the tanks. Such forces tend to flatten the tank shell in a generally vertical direction. As a result of these tank flattening deflections, the eduction pipe is sometimes jammed into the bottom of the tank causing buckling of the eduction pipe, causing damage to the fitting at the top of the car to which the eduction pipe is connected, and causing damage to the lining inside the tank, or to the tank shell itself. Because of the need in prior art constructions to provide at least some clearance allowance between the lower end of the eduction pipe and the bottom of the car to accommodate such tank deflections, a related and continuing problem involves the inability to remove all or substantially all of the fluid from the tank car.

In order to allow limited vertical movement of the eduction pipe while positioning the lower end of the eduction pipe as close as possible to the car bottom or bottom sump area, a variety of prior art constructions have been developed. Examples of such prior art constructions are as follows: U.S. Pat. No. 1,894,655 discloses an offset eduction pipe with its lower end positioned within a bottom sump area; U.S. Pat. No. 4,008,739 employs a drop center car construction with a diagonally positioned eduction pipe; U.S. Pat. No. 4,114,783 discloses the use of a guide seal to allow telescoping movement of an eduction pipe when subjected to tank shell deflection; U.S. Pat. No. 4,219,047 provides an elastomeric boot for a telescoping eduction pipe assembly; U.S. Pat. No. 4,220,097 discloses a continuous cradle pad and skid for protecting a bottom outlet valve incorporating a siphon sump in the cradle pad; U S. Pat. No. 4,237,928 incorporates a low profile tapered sump with a complimentary-shaped guide at the lower end of the eduction pipe; U.S. Pat. No. 4,248,261 provides an upper flexible member for the eduction pipe affording axial collapse thereof; and U.S. Pat. No. 4,513,795 includes selectively variable and automatically operable eduction pipes for different levels of fill in the car.

While certain of these prior attempts to accommodate deflection of the tank and yet to insure maximum evacuation of the tank car worked well, the resulting eduction pipe arrangements were of complicated construction, expensive, and required considerable maintenance. Most new tank cars did not utilize these prior means for accommodating deflection of the tank. As a result, despite the many efforts to eliminate or reduce deflection clearance allowance between the lower end of the eduction pipe and the bottom of the railway tank car, this problem has not been overcome.

SUMMARY OF THE INVENTION

Among the several objects and features of this invention may be noted:

The provision of an eduction or siphon pipe in a railway tank car which readily accommodates radial distortion or deflection of the car;

The provision of such an eduction pipe which permits the interior of the tank to be lined in a conventional manner and which will not damage the lining when the car is in service:

The provision of the aforementioned eduction pipe which does not require any deflection clearance allowance at the bottom or in the bottom sump area of a railway car, thus maximizing removal of the fluid commodity therefrom;

The provision of such an eduction pipe which readily flexes with the tank, and yet which does not require slip fit joints, bendable joints or other complicated constructions to accommodate flexing of the tank;

The provision of the aforementioned eduction pipe which eliminates and/or avoids any damage to the top fitting or tank shell, when the tank shell is subject to radial distortion or deflection during normal operation as well as in an accident environment in which the sump area is permanently deformed upward; and The provision of the aforementioned eduction pipe which can be manufactured from readily available components; is simple and easy to construct and install; does not add materially to the cost; provides relatively long life and service with little or no maintenance; provides efficient removal of fluid commodity products; and is otherwise well adapted for the purposes intended.

Briefly stated, an eduction pipe of the present invention is provided in a railway tank car. The tank car includes a tank and the eduction pipe extends from adjacent a bottom sump area of the tank to a fitting in a top area of the tank. The tank has a generally curvilinear inner wall and the eduction pipe has a shape corresponding to the generally curvilinear inner tank wall and is supported in proximity thereto. The eduction pipe is capable of flexing with the tank to readily accommodate distortions or deflections of the railway tank car during service. Further, the lower end of the eduction pipe is positioned in relatively close proximity to the bottom of the car or within the bottom sump area, without concern for a deflection clearance allowance, thus enabling removal of substantially all of the fluid commodity from within the railway tank car.

Other objects and features of this invention will become apparent from the description that follows.

BRIEF DESCRIPTION OF THE DRAWINGS

FIG. 1 is a fragmentary cross sectional view of a railway tank car employing an eduction pipe which is constructed in accordance with the teachings of the present invention;

FIG. 2 is a sectional view on an enlarged scale taken along line 2—2 of FIG. 1;

FIG. 3 is a side elevational view taken along line 3—3 of FIG. 2;

FIG. 4 is a vertical sectional view of a modified, optional form of the present invention showing the eduction pipe secured to the generally curvilinear inner walls of the railway tank car by means of a suitable synthetic tank lining material;

FIG. 5 is a fragmentary side elevational view, partly in connection adjacent the top area of the railway tank car;

FIG. 6 is a fragmentary side elevational view, partly in section, of a modified form of attachment or mounting for the lower end of the eduction pipe;

Corresponding reference character indicate corresponding parts throughout the several views of the drawings.

DESCRIPTION OF THE PREFERRED EMBODIMENT

Figures 7, 8, 9, 10, 11, 12, 13, 14, 15:
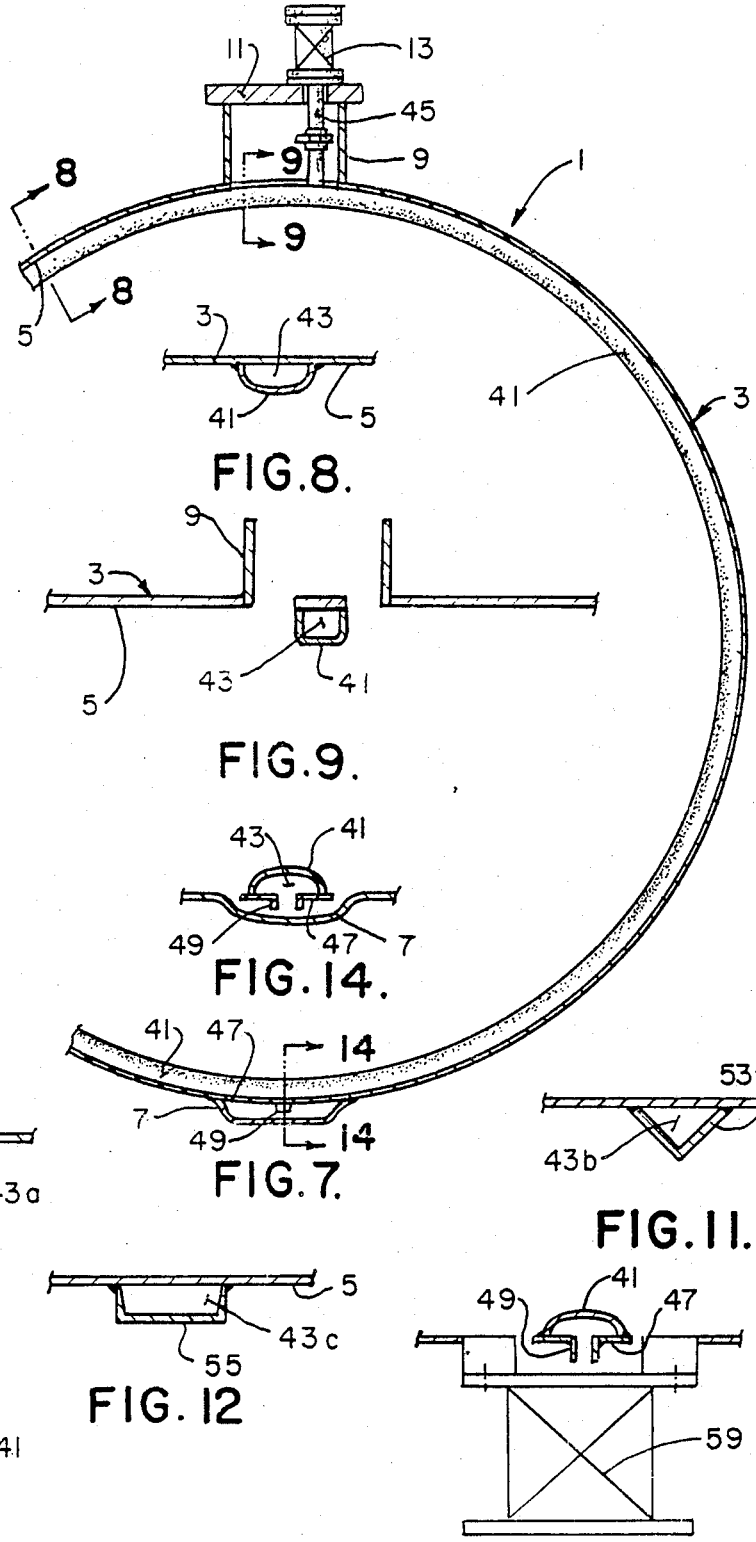
FIG. 7 is a fragmentary cross sectional view of a railway tank car similar to FIG. 1, but employing a modified form of the eduction pipe of the present invention attached to the generally curvilinear inner wall of the railway tank car and extending circumferentially therearound.
FIG. 8 is a fragmentary sectional view on an enlarged scale along line 8—8 of FIG. 7 illustrating the eduction pipe or channel as it is secured to the inner wall of the tank.
FIG. 9 is a fragmentary cross sectional view taken along line 9—9 of FIG. 7.
FIG. 10 is a fragmentary cross sectional view similar to FIG. 8 of another modified form of the eduction pipe shown in FIG. 7 having a cylindrical cross section.
FIG. 11 is a fragmentary cross sectional view similar to FIGS. 8 and 10 of still another modified form of the eduction pipe of the present invention constructed as a V-shaped channel member attached to the inner wall of the tank.
FIG. 12 is still another fragmentary cross sectional view showing yet another modified form of eduction pipe having a rectangular channel-shaped construction which is attached to the inner wall of the tank.
FIG. 13 is a modified form of the invention shown in FIG. 7, with the eduction pipe extending around only one-half of the tank car instead extending fully circumferentially around the tank.
FIG. 14 is a fragmentary sectional view taken along line 14—14 of FIG. 7 at the bottom of the tank car illustrating the eduction pipe of the present invention in communication with a bottom sump provided in the tank.
FIG. 15 is a further modified form of the invention similar to FIG. 14, but also including a conventional bottom outlet valve in conjunction therewith.

Referring now to the drawings, and specifically to FIGS. 1-3, a railway tank car 1, as shown in FIG. 1 of the drawings, has a generally cylindrically shaped body or tank 3 defining a generally cylindrical or curvilinear inner wall 5. At the bottom of the tank 3, a bottom sump area 7 of general semi-spherical or alternately otherwise dished shape is provided, and opposite thereto in the top area of the tank car, a housing 9 having a nozzle cover plate 11 mounted thereon is provided on the outer top of the tank. Mounted on cover plate 11 is a valve 13 having a tubular fitting 15 extending downwardly through cover plate 11 within the housing 9, as shown in FIG. 1.

According to an important feature of the present invention, an eduction or siphon pipe 17, as generally shown in FIG. 1, has a shape corresponding to the generally curvilinear inner wall 5 of tank 3 and is supported relative to the inner wall of the tank so as to distort or deflect with the tank while maintaining its lower or inlet end in communication with sump area 7 without damage to the tank, to a lining (as will appear) on the inside of the tank, or to the eduction pipe. In the embodiment of eduction pipe 17 shown in FIGS. 1-3, a plurality of mounting brackets 19 are utilized for locating and securing the eduction pipe 17 relative to the generally curvilinear inner wall 5 of tank 3. A hose clamp 18 secures eduction pipe 17 to top fitting 15. The eduction pipe 17 in the FIGS. 1-3 embodiment comprises an independently flexible tubing member, such as reinforced flexible tubing, thus allowing the bracket members 19 to readily secure the eduction pipe 17 to the generally curvilinear inner wall 5 and yet to permit the eduction pipe to move with tank 3. As shown in FIGS. 2 and 3, the bracket members 19 include an L-shaped supporting arm 21 about which a circumferential hose type clamp 23 is mounted and into which the independently flexible tubing 17 is captured. Suitable fastening means 25 clamp the eduction pipe 17 to the L-shaped supporting arm 21 in order to securely mount and retain the eduction pipe relative to the generally curvilinear inner wall 5 of the railway tank car.

In those cases where a lined railway tank car is desired, a coating or lining 27 (see FIG. 4) of suitable synthetic resin material or the like, such as is well-known to those skilled in the art, is applied to the inner surface of tank 3 thereby to protect the tank from the lading. In accordance with this invention, it is possible, as shown in FIG. 4 of the drawings, to mount and secure eduction pipe 17 relative to the generally curvilinear inner wall 5 of the railway tank car by molding the lining 27 in-situ around the eduction pipe 17 so as to envelop and secure the eduction pipe 17 relative to the generally curvilinear inner wall. This serves the double function of securing the eduction pipe in place and of lining the eduction pipe. Alternatively, eduction pipe 17 may be secured (welded) to the inner tank wall 5 in a conventional manner and may be coated with lining material 27.

FIG. 5 shows a modified form of the top fitting 15 different from that shown in FIG. 1. Whereas, in FIG. 1, the top fitting 15 was a straight section of pipe or tube, in the FIG. 5 the eduction pipe 17 is shown to be secured by a hose clamp 29 to a conventional metal tube 31 having a 90° elbow 33, and a nipple 34. Thus, it is the metal elbow 33 rather than the flexible eduction pipe 17 which forms the close 90° bend.

In the FIG. 6 modification, the lower end of the eduction pipe 17 is also connected by a hose clamp 35 to a 90° elbow 37 at the lower end of the eduction pipe 17, instead of an integral elbow incorporated in the eduction pipe 17 at the lower end, as shown in FIG. 1 of the drawings. Elbow 37 is in communication with sump area 7.

It is to be noted that in FIGS. 1 and 6 of the drawings, there is no need for a deflection clearance allowance, as in prior art constructions, between the inlet end 1 of the eduction pipe since the clearance at the lower end of the eduction pipe 17 is determined only by the need for fluid passage, not tank deflection. The lower end of the eduction pipe 17 does not move relative to the bottom of the tank, and thus it can be located directly above (or even positioned within) bottom sump area 7, to allow removal of all (or substantially all) of the fluid commodity contained within the railway tank car.

Reference is now made to another embodiment of the present invention shown in FIGS. 7–9 and 14 of the drawings. There, it will be seen that this other embodiment of the eduction pipe, as indicated generally at 41, comprises an endless or generally circular pipe which is configured to the generally cylindrical or curvilinear inner wall 5 of tank 3. As best seen in FIGS. 8–9, the eduction pipe 41 is a channel-shaped member with a cross section approximating one-half of a generally oval configuration. The edges of the channel-shaped eduction pipe 41, as shown in FIGS. 8–9, are sealably secured (welded) to the inner walls 5 of tank 3 in order to define the enclosed eduction passageway 43 for eduction pipe 41.

In the top area of the railway tank car 1, a fitting 45 extends generally vertically between the valve 13 and eduction pipe 41. In the bottom sump area 7, as best seen in FIGS. 7 and 14, eduction pipe 41 is welded to a curvilinear bottom plate 47 as it extends over the bottom sump area 7. The eduction pipe 41 includes a downwardly extending inlet nozzle 49 which is in register and in communication with bottom sump area 7. Thus, upon unloading of a liquid (or fluid) commodity from within tank 3, the liquid is drawn (or forced) into eduction pipe 41 via inlet nozzle 49 at the very bottom of tank 3. This minimizes the amount of residual liquid lading that remains in the tank after unloading. Yet, it will be appreciated that, with the broader aspects of this invention, eduction pipe 41 may readily flex with tank 3.

Additional variations of the present as shown in FIGS. 10–13 and 15 of the drawings. In FIG. 10, a closed metal tube 51 having a cylindrical cross section is welded to the curvilinear inner wall 5 of the tank 3. FIG. 11 of the drawings shows a V-shaped channel member 53 welded to the curvilinear inner wall 5, and FIG. 12 shows a rectangular-shaped channel member 55 also attached by welding to the curvilinear inner wall 5. The openings defined by tubes 51, and channel members 53 and 55 are indicated by reference characters 43*a*, 43*b* and 43*c*, respectively. Other shapes and configurations for the eduction pipe of the present invention may be employed as desired.

In FIG. 13 of the drawings, eduction pipe 41 is shown to extend around only about one-half of tank 3 from bottom sump area 7 to housing 9. An end closure plate 57 caps the eduction pipe 41 at the upper end of the tank car.

In FIG. 15, a conventional bottom outlet valve, as generally indicated at 59, is located directly below the nozzle member 49 of the eduction pipe 41. Bottom outlet valve 59 may be of any desired configuration, such as a ball valve as shown in the co-assigned U.S. Pat. No. 4,220,097 which is herein incorporated by reference. This construction is possible since the lower end of the eduction pipe 41 does not move relative to the bottom of the tank. Thus, the bottom outlet valve 59 may be employed for total removal of the fluid commodity within the tank after unloading through the eduction pipe system.

In all of the aforementioned constructions and embodiments, the various eduction pipes shown are connected with one or more of the fittings, as illustrated, to allow the valve means 13 to establish a pressure differential in the eduction pipe to draw fluids contained in the railway tank car 1 from the bottom sump area 7 up through the eduction pipe and out of the railway tank car 1 past the valve means 13. As a result, the eduction pipes of the present invention are permitted to operate in the conventional manner, while at the same time readily accommodating radial distortions or deflections of the railway tank car, without damage to the tank, the lining, or the fittings at the top of the car and also permitting complete or substantially complete evacuation of the contents of the railway tank car through the eduction pipe.

In view of the above, it will be seen that the several objects of the invention are achieved and other advantageous results are obtained.

As various changes could be made in the above constructions without departing scope of the invention, it is intended that all matter contained in the above description or shown in the accompanying drawings shall be interpreted as illustrative and not in limiting sense.

What is claimed:

1. An eduction or siphon pipe in a railway tank car, the latter having a horizontally disposed tank having a bottom, a top, and a sump at the bottom of the said eduction pipe extending from adjacent said bottom sump to a fitting at the top area of the tank, said tank having an inner wall, and said eduction pipe having a shape corresponding to said inner wall and being supported in proximity thereto, with said eduction pipe accommodating distortions of said tank.

2. The eduction pipe as defined in claim 1 wherein said eduction pipe comprises a flexible tube which is attached by mounting brackets to the generally curvilinear inner wall of said tank in order to conform to the shape thereof.

3. The eduction pipe as defined in claim 1 wherein said eduction pipe is initially formed in a complementary shape corresponding generally to the inner wall of said tank car.

4. The eduction pipe as defined in claim 3 wherein said eduction pipe comprises a closed tube secured to the inner face of said tank.

5. The eduction pipe as defined in claim 3 wherein said eduction pipe is a channel-shaped member sealably secured to the inner wall of said tank thereby to define an enclosed passageway constituting said eduction pipe.

6. The eduction pipe as defined in claim 3 wherein said eduction pipe comprises a metal tube which is welded to the inner wall of said tank.

7. The eduction pipe as defined in claim 1 wherein said eduction pipe extends along said inner wall at least between said bottom sump area and said fitting at the top area of said tank.

8. The eduction pipe as defined in claim 7 wherein said eduction pipe extends around the entire circumferential extent of the inner wall of said tank.

9. The eduction pipe as defined in claim 1 wherein said eduction pipe extends at least partially downwardly within the bottom sump area, in order to permit substantially complete evacuation of the contents of the railway tank car through said eduction pipe.

10. The eduction pipe as defined in claim 9 wherein said eduction pipe is supported above the bottom sump area and includes a nozzle member extending within the bottom sump area.

11. The eduction pipe as set forth in claim 7 wherein said eduction pipe has an inlet end in close proximity with said sump so as to permit the eduction or siphoning of substantially all of the liquid from within said tank via said eduction pipe, said inlet end of said eduction pipe being maintained clear of said tank as the latter distorts thereby to protect the tank and the eduction pipe from damage.

12. The eduction pipe as set forth in claim 11 having a bottom outlet valve in fluid communication with any liquid remaining in said sump after removing of said liquid by said eduction pipe.

13. In a railway tank car having a horizontally disposed generally cylindric tank, a sump at the bottom of the tank and a fitting at the top of the tank, an eduction pipe extending from adjacent said bottom sump to said fitting, said fitting having valve means for opening and closing communication between the eduction pipe and the atmosphere outside of said tank, said valve means establishing a pressure differential in the eduction pipe to draw fluids contained in the railway tank car from the bottom sump area up through the eduction pipe and out of the railway tank car past the valve means and said railway tank car having a generally curvilinear inner wall, wherein the improvement comprises: said eduction pipe having a shape corresponding to said generally curvilinear inner wall and being supported in proximity thereto, with said eduction pipe flexing with said tank so as to readily accommodate radial distortions of the tank.

14. The improvement as defined in claim 13 wherein said eduction pipe is supported above the bottom sump and includes a nozzle member in communication with bottom sump, in order to permit substantially complete evacuation of the contents of the railway tank car through said eduction pipe.

* * * * *